US012232568B2

(12) United States Patent
Jeong et al.

(10) Patent No.: US 12,232,568 B2
(45) Date of Patent: Feb. 25, 2025

(54) ATTACHABLE/DETACHABLE TOE CAP FOR WORK SHOES

(71) Applicant: NANOTECHCERAMICS CO., LTD., Busan (KR)

(72) Inventors: Sang Ok Jeong, Busan (KR); Sung Young Park, Busan (KR); Jong Min Lim, Yangsan-si (KR); Sang Young Park, Busan (KR); Tae Yun Kim, Busan (KR)

(73) Assignee: NANOTECHCERAMICS CO., LTD., Busan (KR)

( * ) Notice: Subject to any disclaimer, the term of this patent is extended or adjusted under 35 U.S.C. 154(b) by 0 days.

(21) Appl. No.: 17/932,300

(22) Filed: Sep. 15, 2022

(65) Prior Publication Data

US 2023/0232943 A1 Jul. 27, 2023

Related U.S. Application Data

(63) Continuation of application No. PCT/KR2021/008704, filed on Jul. 8, 2021.

(30) Foreign Application Priority Data

Nov. 19, 2020 (KR) ..... 10-2020-0155262

(51) Int. Cl.
*A43B 23/08* (2006.01)
*A43C 19/00* (2006.01)

(52) U.S. Cl.
CPC ..... *A43B 23/081* (2013.01); *A43C 19/00* (2013.01)

(58) Field of Classification Search
CPC ..... A43C 13/14; A43C 15/02; A43C 15/12; A43B 13/22; A43B 5/18; A43B 3/246; A43B 23/081
See application file for complete search history.

(56) References Cited

U.S. PATENT DOCUMENTS 2,994,137 A * 8/1961 Anderson ..... A43C 13/14 36/72 R
5,689,901 A * 11/1997 Bell ..... A43B 5/18 36/62

(Continued)

FOREIGN PATENT DOCUMENTS

AU 2019256731 A1 * 12/2020 ..... A43B 5/18

*Primary Examiner* — Jillian K Pierorazio
(74) *Attorney, Agent, or Firm* — BROADVIEW IP LAW, PC

(57) ABSTRACT

An attachable/detachable toecap coupled to the front of the work shoes is disclosed. The attachable/detachable toecap coupled to the front of the work shoe comprises a top plate formed to cover toes and a portion of top of a foot; a side plate formed to extend downwards from the side of the top plate and to surround the top plate; a bottom plate formed to be under the side plate and to cover the bottom of the front of the work shoe; and an anti-separation means for preventing separation of the toecap from the work shoes, wherein the anti-separation means further comprises coupling blocks protruding from the bottom of the work shoe and coupling grooves formed to have vertical perforations at the position corresponding to the coupling blocks, so that the coupling blocks are snap-fitted to prevent the separation of the toecap from the work shoe.

1 Claim, 4 Drawing Sheets

(56) References Cited

U.S. PATENT DOCUMENTS 6,154,982 A * 12/2000 Bell ..... A43B 5/18 36/7.6
6,836,977 B2 * 1/2005 Larson ..... A43B 13/223 36/59 R
RE42,965 E * 11/2011 Larson ..... A43C 15/168 36/59 R
RE44,193 E * 5/2013 Larson ..... A43C 15/168 36/59 R
8,991,069 B2 * 3/2015 Jones ..... A43C 15/061 36/62
9,993,045 B2 * 6/2018 Graffeo ..... A43B 5/002
2004/0049949 A1 * 3/2004 Valentini ..... A43C 13/14 36/77 R
2005/0188562 A1 * 9/2005 Clarke ..... A43B 3/244 36/3 R
2006/0021260 A1 * 2/2006 Kim ..... A43B 21/39 36/130
2008/0184591 A1 * 8/2008 Chang ..... A43C 15/167 36/7.1 R
2010/0139118 A1 * 6/2010 Park ..... A43B 5/001 36/62
2010/0223814 A1 * 9/2010 Ignacio ..... A43B 3/16 36/73
2011/0047829 A1 * 3/2011 Bell ..... A43C 15/161 36/62
2011/0154690 A1 * 6/2011 Walsh ..... A43B 5/18 12/142 P
2013/0312294 A1 * 11/2013 Tang ..... A43C 15/12 36/59 R
2014/0075787 A1 * 3/2014 Cartagena ..... A43B 13/36 36/25 R
2015/0000164 A1 * 1/2015 Dekovic ..... A43B 13/00 36/103
2015/0189949 A1 * 7/2015 Jones ..... A43C 15/02 36/62
2016/0206048 A1 * 7/2016 Weidl ..... A43B 13/30
2017/0196297 A1 * 7/2017 Chung ..... A43B 3/18
2017/0318904 A1 * 11/2017 McDonald ..... A43B 13/12
2018/0325218 A1 * 11/2018 Cavaliere ..... A43B 13/26
2019/0142110 A1 * 5/2019 Cruz ..... A43B 3/16 36/15
2019/0231024 A1 * 8/2019 Smith ..... A43C 1/00
2021/0330037 A1 * 10/2021 Chaney ..... A43C 15/061
2022/0022596 A1 * 1/2022 Truelsen ..... A43B 5/06

* cited by examiner

ATTACHABLE/DETACHABLE TOE CAP FOR WORK SHOES

TECHNICAL FIELD

The present invention relates to an attachable/detachable toe cap for work shoe.

BACKGROUND ART

A toecap is a cap-type product made to protect the toes and the front part of the foot, and is widely used in most work shoe today. The toecap not only protects the toes, but also protects the foot from the impact to the front of the foot. The toecaps used to be made of stainless steel, but recently they are manufactured using the plastics or composite materials.

Toecaps are necessarily used for safety when an impact is expected on the front of the foot, when there is a risk of heavy objects falling on the toe and foot, when using wheeled equipment, and when performing downward action such as pickaxing, shoveling or axing.

As disclosed in 'Toe Cap for Safety Shoes (KIPO Registration Number: 20-0337745)', the toecap normally consists of a roundly curved upper plate and a bottom plate integrally formed by bending inward from the lower end of the upper plate. Here, the ribs having a lattice structure are formed to protrude into the inside of the top plate, and a plurality of concave grooves are formed on the upper surface of the bottom plate to form a lattice structure, so that the lattice structured ribs serve to mitigate external impact. Such kind of toecap has an advantage of reducing the fatigue on the operator's feet by reducing the load to the toecap, but also has a disadvantage of easily damaged due to the nature of the plastic.

Also, as disclosed in 'plastic toecap for safety shoes (KIPO Registration Number: 10-0631341),' the plastic toecap is composed of an upper plate protecting the upper part of the toe, a side part that extends downward from the edge of the upper plate and one side is open, and a bottom ribs that are bent inward from the bottom of the upper part and extended, wherein the top plate, the side part, and the bottom ribs are formed integrally with plastic materials. While such a toecap has the advantage of being lighter and more cold-resistant than metal ones, it also has the disadvantage that it tends to be easily broken at the front-end plastic binding by the insufficiently decreased vibration, which is generated by the load from the top and damages the bonding of the plastic parts damages.

In order to solve the problems mentioned above, 'Plastic toe cap for safety boots (KIPO Registration Number: 10-0976265)' discloses a toecap made of a polycarbonate and polycarbonate mixed composition to provide the improved impact resistance and the reduced weight.

As such, conventional technologies related to the toecaps merely tend to focus on improving impact resistance and lighter weight, and because work shoe and toecaps are usually bonded to each other by adhesives, it is impossible to replace an old toecap with a new toecap, which demands that people keep purchasing new work shoe.

Therefore, development for technologies that can improve the bonding between work shoe and toe caps to prevent separation and that can replace the used toecaps with new toecaps is required.

DISCLOSURE

Technical Problem

The present invention is to solve the above problems by provide a attachable/detachable toecap for work shoe that can prevent separation from work shoe and be easily replaced after use.

Technical Solution

To solve the above problem, the present invention discloses an attachable/detachable toecap coupled to the front of the work shoe, comprising a top plate formed to cover toes and a portion of top of a foot; a side plate formed to extend downwards from the side of the top plate and to surround the top plate; a bottom plate formed to be under the side plate and to cover the bottom of the front of the work shoe; and an anti-separation means for preventing separation of the toecap from the work shoes, wherein the anti-separation means further comprises a plurality of coupling blocks protruding from the bottom of the work shoe and a plurality of coupling grooves formed to have vertical perforations at the position corresponding to the coupling blocks, so that the plurality of coupling blocks are snap-fitted to prevent the separation of the toecap from the work shoe.

It is desirable that the coupling blocks are formed to be divided by a plurality of groove lines at the bottom of the work shoe; and the coupling grooves are formed to be divided by a plurality of bottom lines formed at the bottom plate.

It is desirable that the plurality of bottom lines further comprises a first bottom line formed to be inclined upward at a certain portion of the lower end of the bottom plate; a second bottom line formed to be inclined upward at a neighboring position on the side of the first bottom line apart from the first bottom line by a predetermined distance; a third bottom line formed to connect the first bottom line and the second bottom line; and a fourth bottom line formed to connect the second bottom line and the end of the bottom plate.

Advantageous Effects

According to the above description, the separation of the toecap and the work shoe is prevented by snap-fitting the plurality of coupling blocks 410 to the plurality of coupling grooves.

The work shoe and toecaps of the prior arts are usually bonded to each other by adhesives, it is impossible to replace an old toecap with a new toecap, which demands that people keep purchasing new work shoe. To the contrary, the disclosed invention has the advantage in that the toecap is replaceable by detaching the old toecap and attaching the new one.

BEST MODE

Hereinafter the present invention is described in detail.

Figure 1:
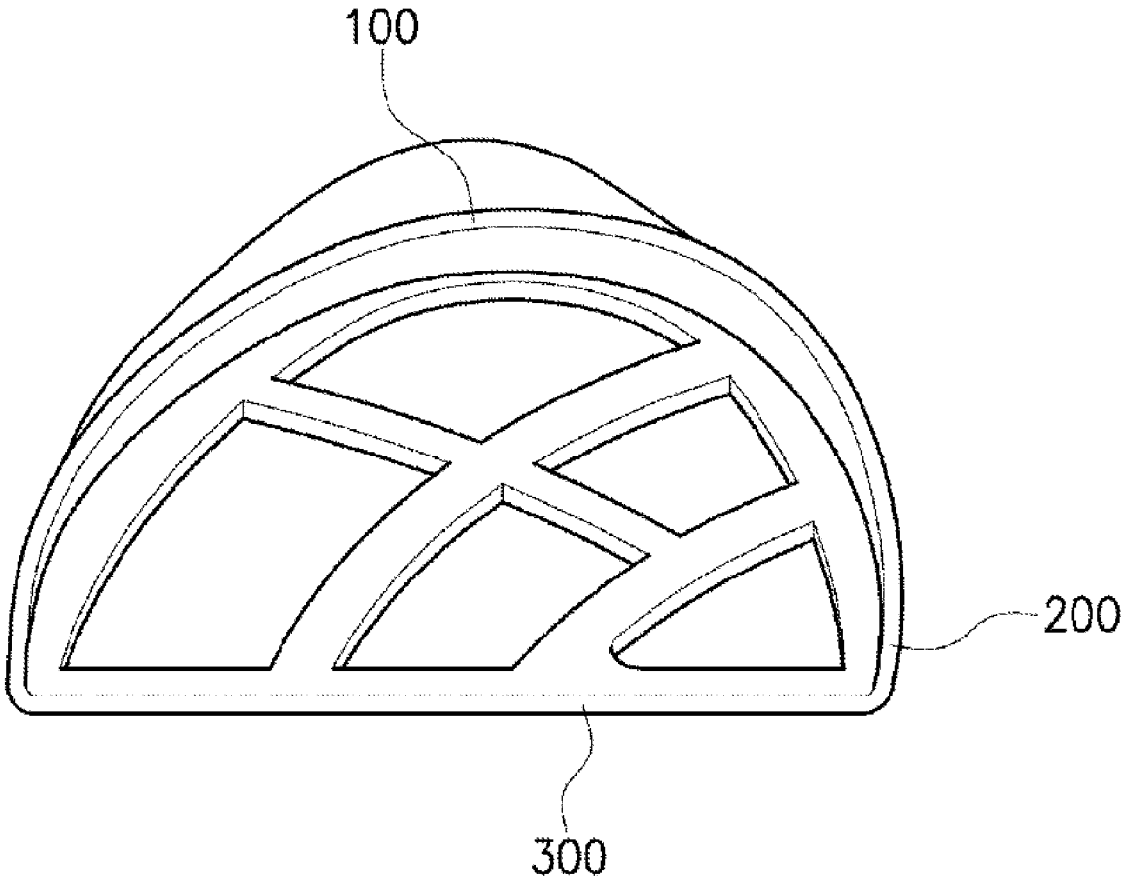
FIG. 1 is a perspective view showing a toecap according to the present invention.
Figure 2:
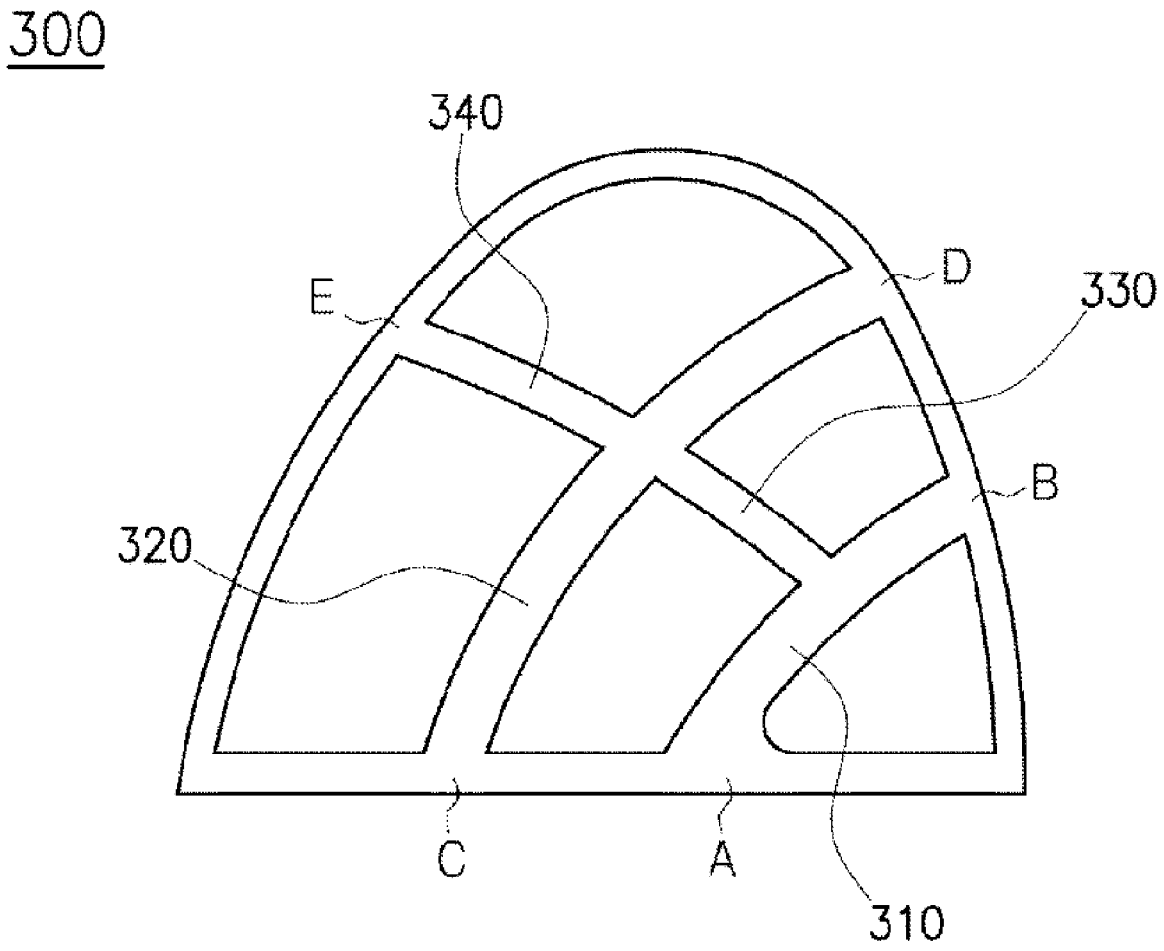
FIG. 2 is a top view showing the bottom plate according to the present invention.
Figure 3:
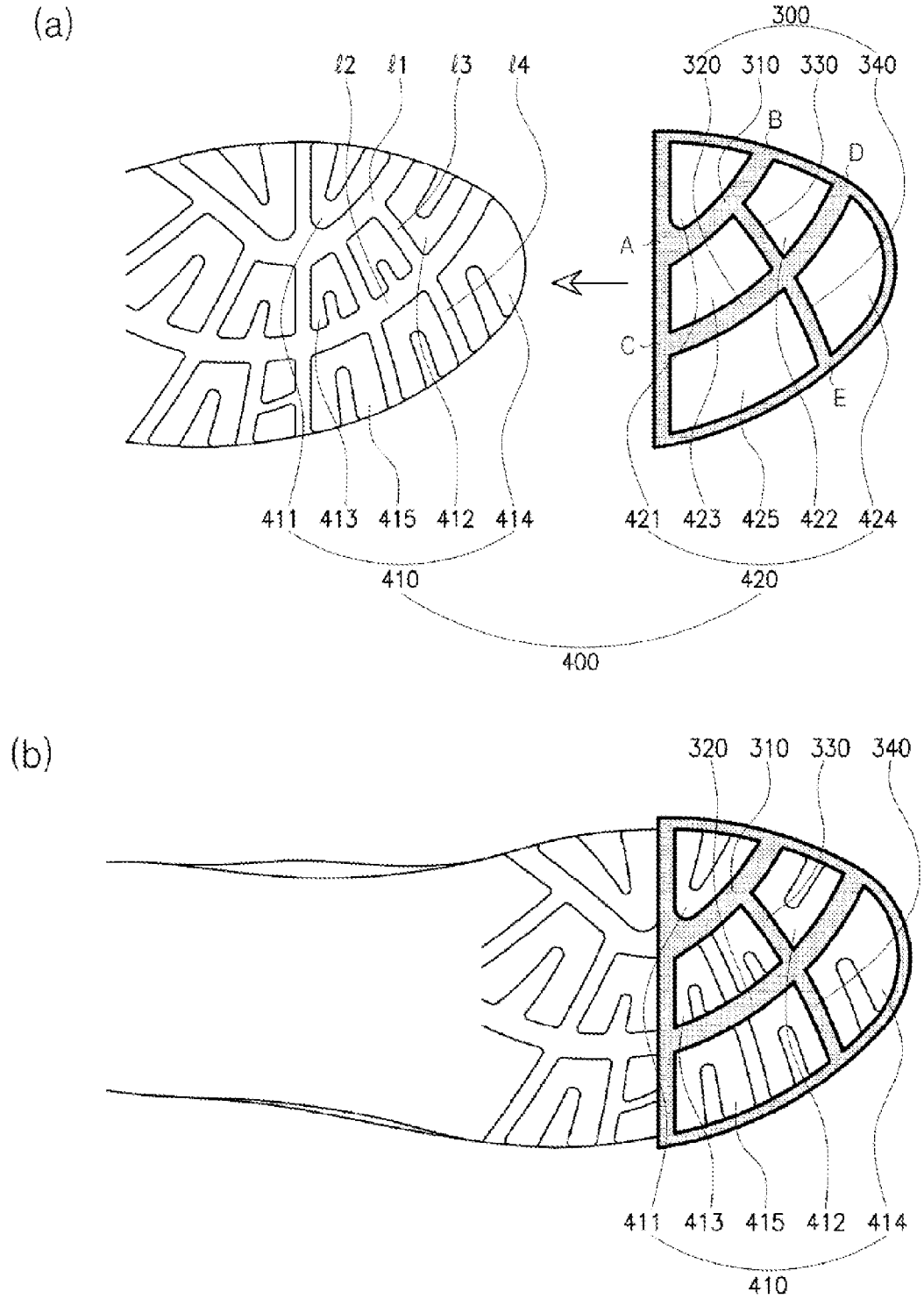
FIG. 3 is an exemplary drawing showing a process in which the toecap is coupled to the work shoe.
Figure 4:
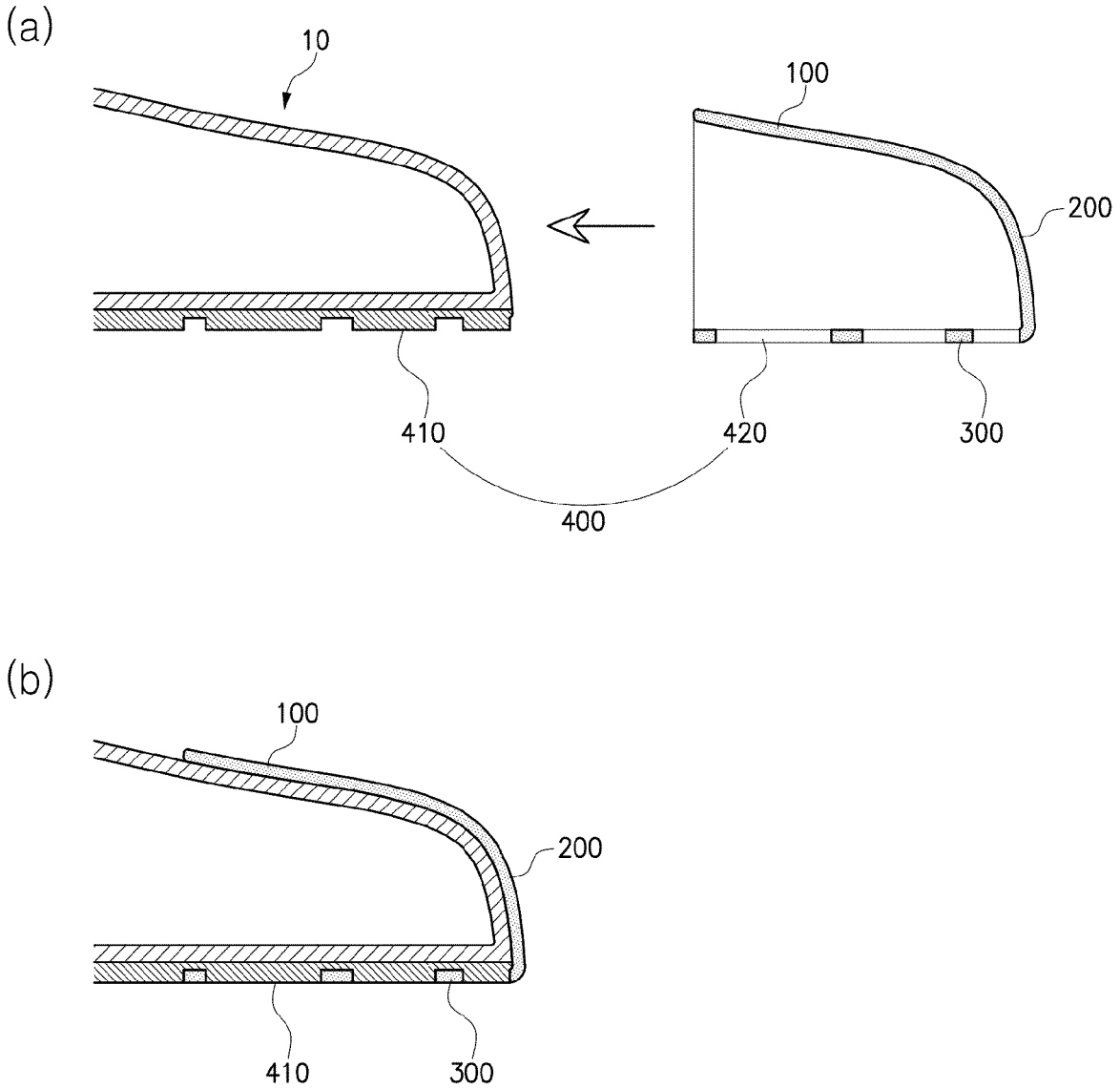
FIG. 4 is a side view of FIG. 3.

FIG. 1 is a perspective view showing a toecap according to the present invention, FIG. 2 is a top view showing the bottom plate according to the present invention. FIG. 3 is an exemplary drawing showing a process in which the toecap is coupled to the work shoe, and FIG. 4 is a side view of FIG. 3.

As shown in FIGS. 1 to 4, the present invention relates to a toecap coupled to the front of a work shoe 10 to protect the top and toes of the foot, and comprises a top plate 100 formed to cover toes and a portion of top of a foot, a side plate 200 formed to extend downwards from the side of the top plate 100 and to surround the top plate 100, a bottom plate 300 formed to be under the side plate 200 and to cover the bottom of the front of the work shoe 10, and an anti-separation means 400 for preventing separation of the toecap from the work shoe 10.

The upper plate 100 is configured to be rounded so as to surround the toes and a portion of the top of the foot.

The material for the top plate portion 100 is not limited, but may be a metal, a plastic, or a composite of metal and plastic. Among them, it is preferable to be a plastic or a composite that can be applied to light stabilization or the like. In the case the material of the top plate 100 is a plastic or a composite, it may be manufactured by injection molding, and in the case the material is a metal such as stainless steel, it may be manufactured by pressing a flat plate.

The side plate 200 extends downward from the side of the top plate 100 and surrounds the top plate 100.

In other words, the side plate 200 serves as a wall that protects the side of the foot while surrounding the side of the toecap, and extends downward vertically from the outer rim of the top plate 100. The side plate 200 may also be formed to have the same thickness as the top plate 100 and manufactured together with the top plate 100 by press molding.

The bottom plate 300 is formed at the lower portion of the side plate and covers the lower surface of the front of the work shoe 10.

As shown in FIG. 2, the structure of the bottom plate 300 comprises a bottom part and a curved surface at both sides of the bottom part so that it can be coupled to the front of the work shoe 10. It means the bottom plate 300 has a shape in which the width becomes narrower toward the front.

The bottom plate 300 comprises a plurality of bottom lines so that the coupling grooves 420 of the toecap can be coupled with the coupling blocks 410 protruding from the sole of the work shoe 10. The plurality of bottom lines include a first bottom line 310, a second bottom line 320, a third bottom line 330 and a fourth bottom line 340.

The first bottom line 310 is formed to be inclined upward at a certain portion of the lower end of the bottom plate 300. The first bottom line 310 may be formed to connect the point A at one side of the bottom plate 300 and the higher point B at the curved surface.

The second bottom line 320 is formed to be inclined upward at a neighboring position on the side of the first bottom line 310 apart from the first bottom line 310 by a predetermined distance. The starting point of the second bottom line 320 may be formed to connect the point C, which is spaced apart from the point A by a predetermined interval, and a point D, which is spaced apart from the point B formed on the curved surface by a predetermined distance.

The third bottom line 330 is formed to connect the first bottom line 310 and the second bottom line 320. The third bottom line 330 divides the space between the first bottom line 310 and the second bottom line 320 by connecting a point on the first bottom line 310 and another point on the second bottom line 320 so as to form the second coupling groove 422 and the third coupling groove 423.

The fourth bottom line 340 is formed to connect the second bottom line 320 and the end of the bottom plate 300. The fourth bottom line 340 can be formed by connecting a line extending from a point of the second bottom line 320 to the third bottom line 330 and the point E at the other side of the curved surface.

The anti-separation means 400 comprises a plurality of coupling blocks 410 protruding from the bottom of the work shoe 10 and a plurality of coupling grooves 420 formed to have vertical perforations at the position corresponding to the coupling blocks 410, so that the plurality of coupling blocks are snap-fitted to prevent the separation of the toecap from the work shoe 10.

The coupling blocks 410 are formed to be divided by a plurality of concave lines recessed at the bottom of the work shoe 10. The coupling blocks 410 comprises multiple blocks including a first coupling block 411, a second coupling block 412, a third coupling block 413, and a fourth coupling block 414.

Each of the first coupling block 411, the second coupling block 412, the third coupling block 413, and the fourth coupling block 414 is formed to be divided by the groove line ℓ1, the second groove line ℓ2, the third groove line ℓ3, and the fourth groove line ℓ4 and be protruded as shown in FIG. 3.

The first coupling block 411 protrudes from a position corresponding to the first coupling groove 421 and is snap-fitted into the first coupling groove 421. The second coupling block 412 protrudes from a position corresponding to the second coupling groove 422 and is snap-fitted into the second coupling groove 422. The third coupling block 413 protrudes from a position corresponding to the third coupling groove 423 and is snap-fitted into the third coupling groove 423. And the fourth coupling block 414 protrudes from a position corresponding to the fourth coupling groove 424 and is snap-fitted into the fourth coupling groove 424.

The coupling grooves 420 are formed to be divided by a plurality of bottom lines formed on the bottom plate 300. Similar to the coupling blocks 410, the coupling grooves 420 also comprises a plurality of grooves including the first coupling groove 421, the second coupling groove 422, the third coupling groove 423, and the fourth coupling groove 424.

Each of the first coupling groove 421, the second coupling groove 422, the third coupling groove 423, and the fourth coupling groove 424 is formed to be divided by the first bottom line 310, the second bottom line 320, the third bottom line 330, and the fourth bottom line 340 formed at the bottom plate 300 of the toecap, as shown in FIG. 3.

Hereinafter, the process of attaching or detaching the toecap to/from the work shoe 10 is described in detail.

As shown in FIGS. 1 and 2, the toecap, which comprises the top plate 100, the side plate 200, and the bottom plate 300, is prepared. At the bottom plate 300, the first coupling groove 421, the second coupling groove 422, the third coupling groove 423 and the fourth coupling groove 424 of the anti-separation means 400 are formed by the first bottom line 310, the second bottom line 320, the third bottom line 330, and the fourth bottom line 340. And, as shown in Section (a) of FIG. 3 and Section (a) of FIG. 4, the work shoe 10 is prepared, where the first coupling block 411, the second coupling block 412, the third coupling block 413, and the fourth coupling block 414 are formed to protrude from the sole.

As shown in Section (b) of FIG. 3 and Section (b) of FIG. 4, thereafter, each of the first coupling block 411, the second coupling block 412, the third coupling block 413, and the fourth coupling block 414 is snap-fitted to the first coupling groove 421, the second coupling groove 422, the third coupling groove 423, and the fourth coupling groove 424 formed ay the bottom plate 300, and the attachment of the toecap to the work shoe is completed.

In the case that the toecap needs to be replaced, the first coupling block 411, the second coupling block 412, the third coupling block 413, and the fourth coupling block 414 formed at the bottom of the work shoe 10 are decoupled from the first coupling groove 421, the second coupling groove 422, the third coupling groove 423, and the fourth coupling groove 424 formed at the bottom plate 300, and a new toecap is again attached to the front of the work shoe 10.

According to the above description, the separation of the toecap and the work shoe 10 is prevented by snap-fitting the plurality of coupling blocks 410 to the plurality of coupling grooves 420.

The work shoe and toecaps of the prior arts are usually bonded to each other by adhesives, it is impossible to replace an old toecap with a new toecap, which demands that people keep purchasing new work shoe.

To the contrary, the disclosed invention has the advantage in that the toecap is replaceable by detaching the old toecap and attaching the new one.

The above description is merely an example of the technical idea of the present invention, and various modifications and variations can be made to those skilled in the art without departing from the essential characteristics of the present invention. Therefore, the embodiments disclosed in the present invention are not intended to limit the technical idea of the present invention, but are intended to explain, and the scope of the technical idea of the present invention is not limited by these embodiments. The protection scope of the present invention should be interpreted by the claims, and all the equivalent technical ideas should be interpreted as included within the scope of the present invention.

What is claimed is:

1. An attachable/detachable toecap coupled to a front of a work shoe, comprising:

a top plate formed to cover toes and a portion of top of a foot;

a side plate formed to extend downwards from the top plate and to surround the top plate;

a bottom plate formed to be under the side plate and to cover a bottom surface of the front of the work shoe; and an anti-separation means for preventing separation of the attachable/detachable toecap from the work shoe, wherein the anti-separation means further comprises a plurality of vertically perforated coupling grooves, wherein the coupling grooves are formed to be at a position overlaying to a plurality of coupling blocks protruding from the bottom surface of the work shoe, so that the plurality of coupling blocks are snap-fitted to the coupling grooves to prevent the separation of the attachable/detachable toecap from the work shoe, wherein the coupling blocks are formed to be divided by a plurality of groove lines at the bottom of the work shoe, wherein the coupling grooves are formed to be divided by a plurality of bottom lines formed at the bottom plate, and wherein the plurality of bottom lines further comprises:

a first bottom line formed to connect a first point at one side of the bottom plate and a second point at another side of the bottom plate;

a second bottom line formed to be inclined upward at a neighboring position of the first bottom line apart from the first bottom line by a predetermined distance and to connect a third point, which is spaced apart from the first point at one side of the bottom plate, and a fourth point, which is spaced apart from the second point at another side of the bottom plate;

a third bottom line formed to connect the first bottom line and the second bottom line; and a fourth bottom line formed to connect the second bottom line and a fifth point at still another side of the bottom plate.

* * * * *